US006155347A

United States Patent [19]

Mills

[11] Patent Number: 6,155,347

[45] Date of Patent: Dec. 5, 2000

[54] METHOD AND APPARATUS FOR CONTROLLING THE LIQUID LEVEL IN A WELL

[75] Inventor: Robert A. R. Mills, Bragg Creek, Canada

[73] Assignee: Kudu Industries, Inc., Canada

[21] Appl. No.: 09/290,160

[22] Filed: Apr. 12, 1999

[51] Int. Cl.[7] ..... E21B 44/00; E21B 44/06

[52] U.S. Cl. ..... 166/250.03; 166/53; 417/10; 417/43

[58] Field of Search ..... 166/250.03, 250.01, 166/53, 104, 105, 105.2; 417/10, 15, 43, 63

[56] References Cited

U.S. PATENT DOCUMENTS

| | | | |
|---|---|---|---|
| 3,951,209 | 4/1976 | Gibbs . | |
| 4,286,925 | 9/1981 | Standish . | |
| 4,487,061 | 12/1984 | McTamaney et al. . | |
| 4,541,274 | 9/1985 | Purcupile | 166/250 |
| 4,583,915 | 4/1986 | Montgomery et al. . | |
| 4,594,665 | 6/1986 | Chandra et al. | 364/422 |
| 5,006,044 | 4/1991 | Walker, Sr et al. | 417/12 |
| 5,237,863 | 8/1993 | Dunham . | |
| 5,281,100 | 1/1994 | Diederich | 417/18 |

FOREIGN PATENT DOCUMENTS

| | | |
|---|---|---|
| 1271539 | 7/1990 | Canada . |

*Primary Examiner*—Frank S. Tsay
*Attorney, Agent, or Firm*—Pendorf & Cutliff

[57] ABSTRACT

The present invention provides a method and apparatus for controlling the production rate of a rotary downhole pump to prevent well pump-off. The method includes the steps of operating the pump at a first speed less than a maximum rate of the pump until well fluid is produced at the wellhead. The operation is continued at the first speed until a first dynamic fluid level in the annulus between the production tubing and the wellbore or the well casing is stabilized. A first static load on the drivehead at the first dynamic fluid level is determined. The pump is then operated at a second speed higher than the first speed until the fluid level in the annulus is stabilized at a second dynamic fluid level. A second static load on the drivehead at the second dynamic fluid level is determined. A linear function of the load on the drivehead is determined as a function of the fluid level in the annulus. The linear function is used to calculate a critical load on the wellhead at a pump off point of the well where the fluid level in the annulus is equal to the insertion depth of the pump. The speed of the pump is reduced when the critical load is reached to prevent pump-off. The method and apparatus of the invention provides for the monitoring and control of the well pumping operation to prevent pump-off without the need for downhole monitoring or measuring equipment.

11 Claims, 4 Drawing Sheets

METHOD AND APPARATUS FOR CONTROLLING THE LIQUID LEVEL IN A WELL

FIELD OF THE INVENTION

The present invention relates to an apparatus and a method for monitoring the liquid level in a well.

BACKGROUND OF THE INVENTION

When pumping a production well, it is desirable to run the pump at a speed where the pump production closely matches the maximum production of the well. This is achieved by pumping the well down as close as possible to the pump inlet to minimize back pressure of liquid in the well annulus on the oil-bearing formation and, thus, maximize the flow of formation fluid to the pump. However, the liquid level may drop below the level of the pump inlet resulting in burnout of the pump. It is therefore necessary to ensure that the liquid level remains within a range which allows for optimum well production but prevents pump burnout due to pump-off.

A number of systems are known for this purpose which simultaneously measure the load on the rod string as well as its position. Load cells are used and are mounted on the rod string of the pump.

U.S. Pat. No. 3,951,209 discloses a method for calculating the energy output to the rod by integrating the product of the load on the rod and the displacement of the rod. If a reduction in energy input to the rod is detected, a signal is produced to trigger shut down of the pump.

U.S. Pat. No. 4,286,925 describes a system wherein the pump is shut down when the rod string load exceeds a preset value on the downstroke which signals pounding due to pump off or is smaller than a preselected value on the upstroke thereby signaling rod failure. Again rod load and position are measured simultaneously.

U.S. Pat. No. 4,583,915 discloses a pump-off controller which calculates the area defined by the minimum load, two user defined positioning lines, and the load at the time of calculation. This area is compared to a user-defined limit and the pump shuts down when the area value is below the limit.

U.S. Pat. No. 4,487,061 describes a system which detects abrupt increases in rod string load during the downstroke signaling fluid pound. The pump is shut down when fluid pound is detected.

U.S. Pat. No. 5,237,863 describes a method of preventing pump-off wherein maximum and minimum values are measured for both the rod string load and the rod position. The measured analog values are converted into digital values and expressed in terms of percentages. This prevents the pump from being shut down prematurely due to a high liquid level in the well. At high fluid levels, the energy required to operate the pump is much reduced leading to a reduced area as calculated according to the above discussed methods. As percentages are used, the change in the area is automatically compensated and false shutdowns are avoided.

None of the prior art devices deal with rotary downhole pumps nor do they provide for a method to measure and control the fluid level in the well.

SUMMARY OF THE INVENTION

There is a need for a reliable method for determining either intermittently or continuously the fluid level in a well, and, in particular, a well produced with a progressing cavity pump.

There is also a need for a method and apparatus for continuously detecting the fluid level in a well without using downhole measuring equipment.

The present invention provides for a method for controlling the production rate of a rotary downhole pump to prevent well pump-off. The pump is driven by a drive string suspended from a drive head at a wellhead of the well. An annulus is formed between the production tubing and the well casing. The pump is positioned in the well at an insertion depth L. The method of the present invention comprises the steps of: operating the pump at a first speed less than a maximum rate of the pump until well fluid is produced at the wellhead; continuing operation of the pump at the first speed until the fluid in the annulus has stabilized at a first dynamic fluid level M; determining a first static load x on the drivehead at the first dynamic fluid level; operating the pump at a second speed higher than the first speed until the fluid level in the annulus has stabilized at a second dynamic fluid level N; determining a second static load y on the drivehead at the second dynamic fluid level; determining a linear function of the load on the drivehead as a function of the fluid level in the annulus; and reducing the speed of the pump when a critical load z on the wellhead is reached, which critical load is calculated on the basis of the linear function and corresponds to the level where the fluid level in the annulus is equal to the insertion depth of the pump. The first and second dynamic fluid levels in the annulus can be determined by means well known in the art.

In a preferred embodiment, the method of the invention further includes the step of sending a signal to a variable speed means for altering the speed of the pump as the critical load is approached.

The linear function of the load on the drivehead is preferably determined according to the following formula:

$$N-M=C(y-x) \tag{I}$$

wherein $C=(N-M)/(y-x)$ and C has the units of meters per deca Newton or feet per pound or some similar combination of a linear measurement per unit of load on the drivehead.

In another preferred embodiment, the method includes the further step of setting a display at N,y with the sensitivity of the display being C for displaying the depth of the fluid level in the annulus, so that when the strain gauge signal is z, the fluid level displayed is the insertion depth of the pump. The method of the invention preferably also includes the step of sending a signal from the display to a variable speed controller for altering the speed of the pump when the display signal approaches a pre-determined minimum or maximum level.

This step of sending a signal from the display to the variable speed controller preferably includes the further step of setting the controller to slow down or stop the pump when the signal output is z and the dynamic fluid level is L, which will protect the pump. The signal output z when the dynamic fluid level is at the pump is calculated as follows:

$$z = x + \frac{(L-M)}{C} \tag{II}$$

A preferred apparatus in accordance with the invention is used for controlling the production rate of a rotary downhole pump to prevent well pump-off, the well having a depth and the pump being driven by a drive string rotating in a production tubing and suspended form a drive head at a wellhead of the well, the pump being positioned in the well at an insertion depth, an annulus being formed between the production tubing and one of the wellbore and the well casing and containing well fluid. The apparatus includes means for producing a load signal which is a function of the static load on the wellhead generated by the pump and drive string suspended therefrom; a processor for monitoring the load signal and generating a control signal when a critical load is reached where the well fluid level in the annulus is equal to the insertion depth of the pump; and a controller for reducing the speed of the pump in response to the control signal generated by the controller.

The processor preferably produces a variable control signal depending on the load signal and the controller is a variable speed controller for gradually reducing the pump speed as the load signal approaches the critical load and the variable speed controller preferably shuts down the pump in response to the control signal.

In another preferred embodiment, the processor produces a variable control signal corresponding to the load signal, the control signal varying between a pump-off signal generated when the critical load is reached and a restart signal corresponding to a load signal representing a pre-elected fluid level less than the insertion depth of the pump, and the controller shuts down the pump when the pump-off signal is produced and reactivates the pump in response to the restart signal.

BRIEF DESCRIPTION OF THE DRAWINGS

The present invention will be described with reference to the preferred embodiments shown in the attached figures in which.

DETAILED DESCRIPTION OF THE PREFERRED EMBODIMENT

Figure 1:
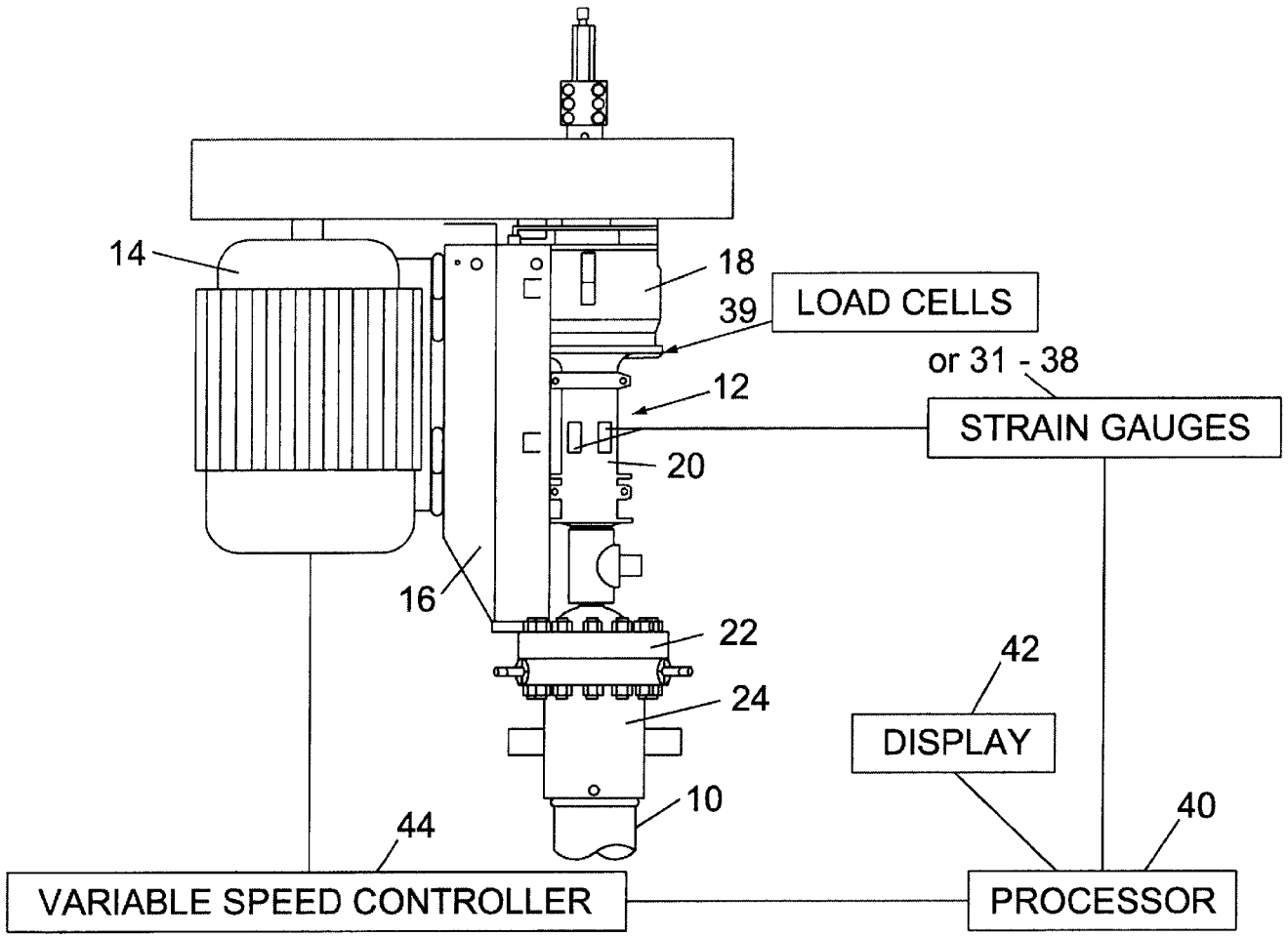
FIG. 1 is a side perspective view of a drivehead assembly with strain gauges or load cells and a variable speed controller.

Referring to the drawings, the present invention provides a method for continuously determining the level of fluid in a well for optimizing well production and for preventing fluid pump-off which may result in burn-out of the pump. The present invention also provides for a load cell controller comprising strain gauges and a processor unit.

Figure 3:
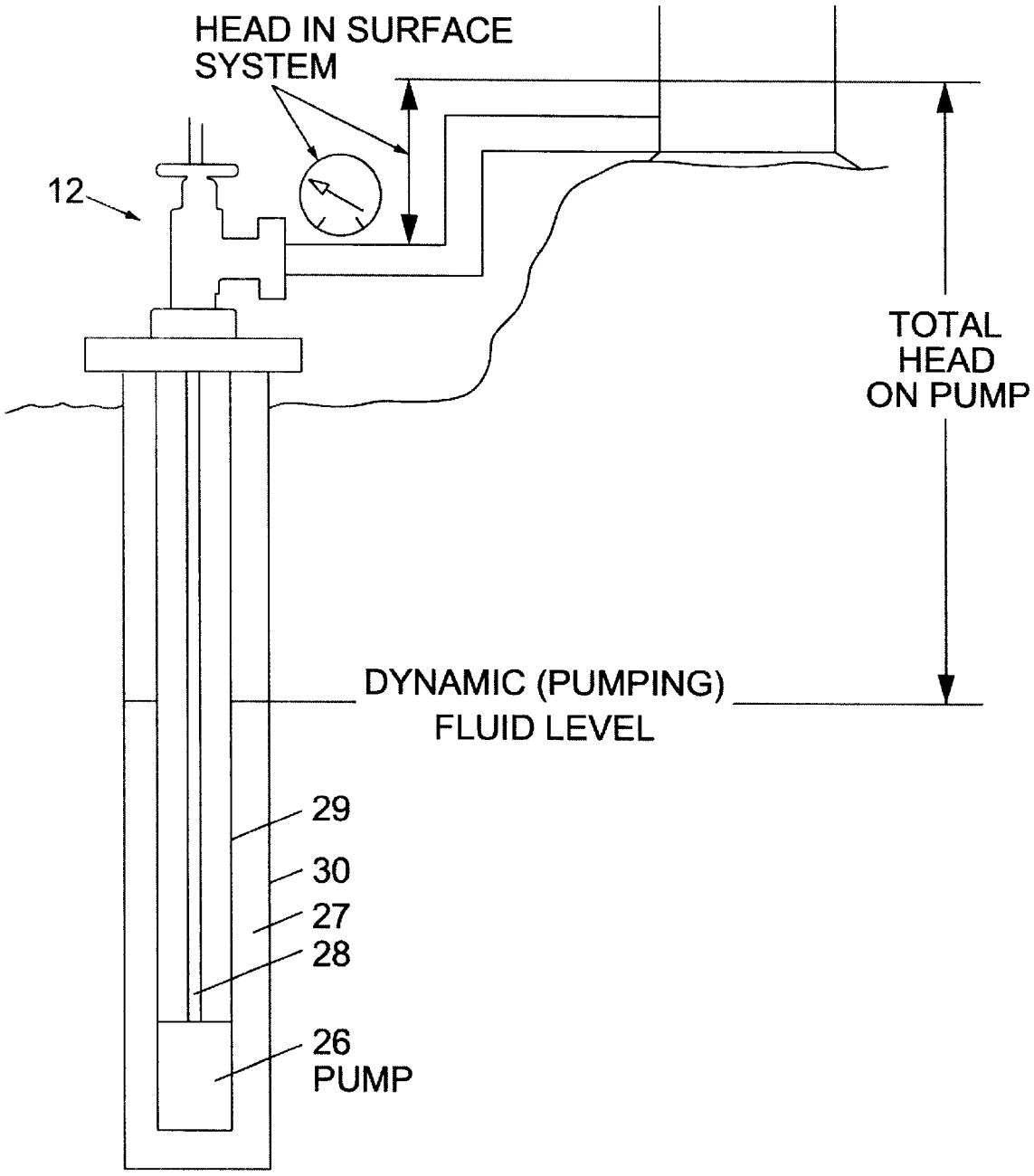
FIG. 3 is a schematic view of the pump and well assembly illustrating the fluid levels and head on the pump.
Figure 4:
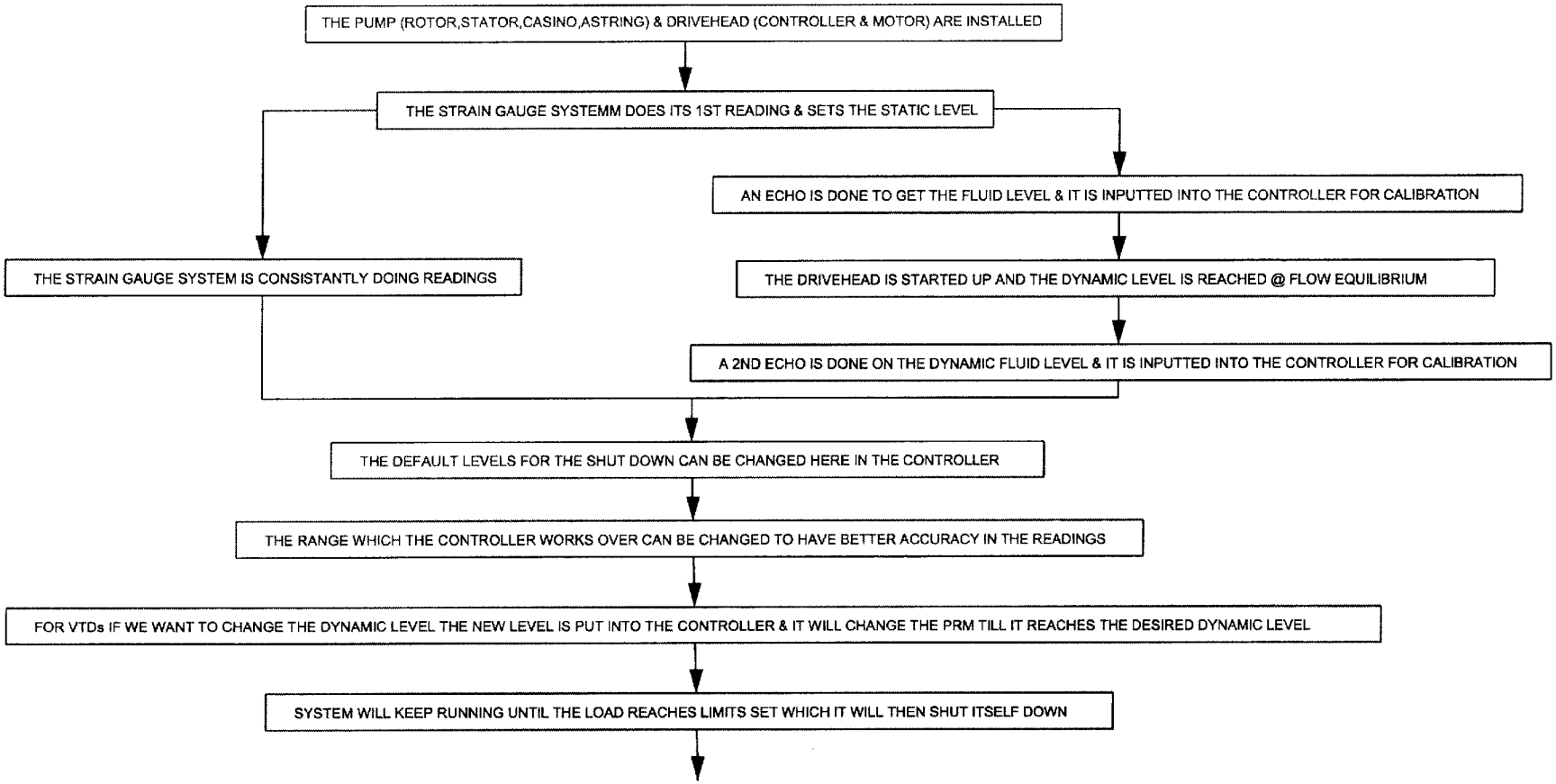
FIG. 4 is a flow chart diagram of one embodiment of the method of the present invention.

The present invention may be used with any standard downhole rotary pump and preferably a progressing cavity pump in an oil well. Any standard installation may be used and a typical drivehead installation for a progressing cavity pump (PCP) is shown in FIG. 1. The well tubing or casing 10 has a wellhead assembly with a drivehead assembly 12 installed thereon. The drivehead assembly 12 includes an electric motor 14, a motor stand 16, a drivehead 18, the wellhead frame 20, a tubing adaptor bonnet 22, and tubing head 24. Any standard assembly commonly known in the industry may be used with the present invention. FIG. 3 gives an overall schematic view of the well with the drivehead assembly installed at the wellhead and a downhole pump 26 installed at the end of a sucker rod 28 or drive string in the well 30 and rotating in a production tubing 29 through which the well liquid is pumped to the wellhead.

Figure 2A:
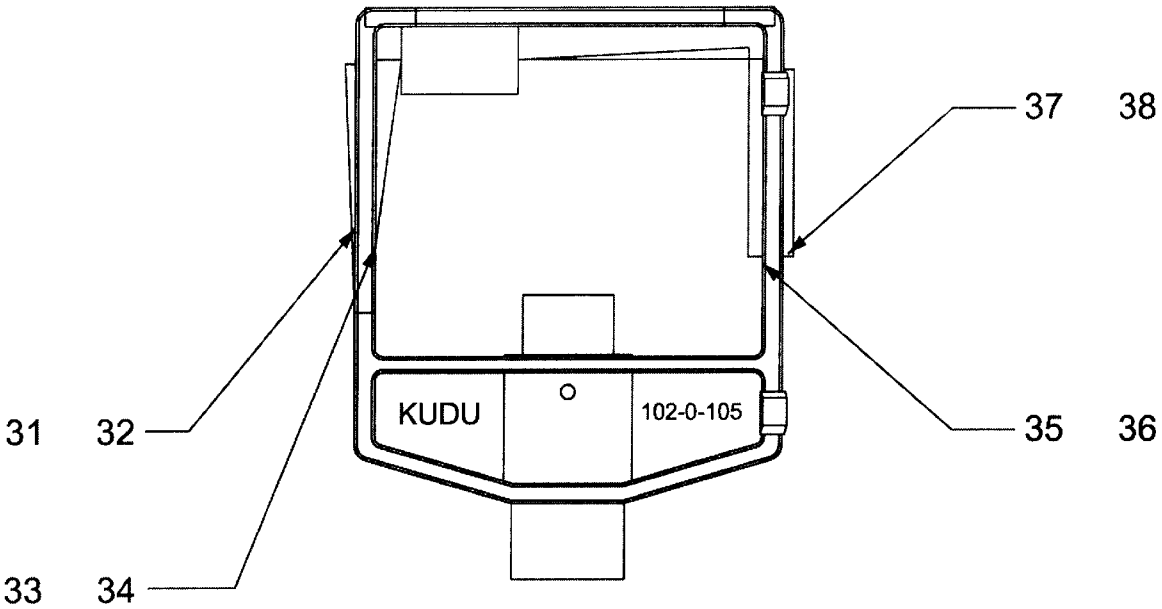
FIG. 2*a* is a cross-sectional view of a drivehead frame with strain gages installed thereon.
Figure 2B:
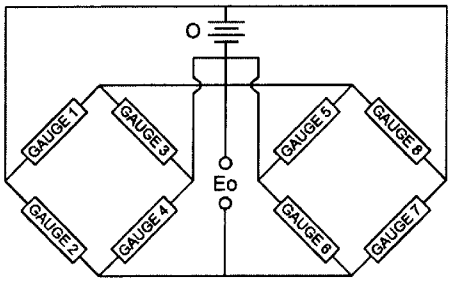
FIG. 2*b* is a schematic circuit diagram showing the electronic connection of eight strain gauges.

As shown in FIG. 2*a*, the drivehead frame 18 is equipped with load cells 39 or strain gauges 31, 32, 33, 34, 35, 36, 37, 38 installed on it. The strain gauges are used to measure varying strain on the drivehead frame 18 due to varying static and dynamic fluid levels in the wellbore 30. The load cells and strain gauges measure deformation and preferably are installed in case of the load cells at 39 between the bearing box (or gear box) and the yoke (or wellhead frame) and in the case of the strain gauges on the frame 18. Some preferred positions for placing the strain gauges on the drivehead assembly are shown in FIG. 2*a*. In the embodiment shown, even numbered gauges 32, 34, 36, 38 measure the vertical deflection while odd numbered gauges 31, 33, 35, 37 measure the horizontal deflection. Their electrical connection is shown in the schematic circuit shown in FIG. 2*b*.

Referring now to FIG. 1, the strain gauges are connected to a standard micro processor unit 40. The processor 40 records the signals from the strain gauges 31 to 38 and may display the resulting output on a display 42 in varying measurements, for example, weight in pounds or kilograms or can be calibrated to display the depth to the fluid level in meters, feet, or joints. The processor 40 may also be connected to a variable speed controller 44 or to an on-off switching device replacing the speed controller. The processor 40 will send a signal to the controller/switching device 44 connected to the motor 14 to regulate the pump operation when pre-determined minimum and maximum fluid levels in the well are reached.

The static fluid level in the annulus between the production tubing and the well casing is determined using a fluid level sounder or by means of bottom hole pressure gauges (not shown). Each of these devices is well known in the industry and readily commercially available.

When pumping a producing well 30, it is desirable to pump at a rate that closely matches the maximum production of the well. This is achieved by pumping the well down as close to the inlet of the pump 26 as possible to minimize back pressure of liquid in the well on the producing formation. The pump speed is adjusted to keep the liquid level in the annulus just above the pump thus maximizing production. To determine the liquid level above the pump, the load on the drive head 18 may be measured. The drive head load consists of a static load and a dynamic load. The static load consists of the mass of the drive string 28 minus buoyancy of the string in the liquid in the production tubing 29. The dynamic load consists of the hydrostatic pressure on the effective piston area of the rotor of the pump 26. This dynamic load is a linear function of the difference in head of the fluid in the production tubing and the fluid in the annulus 27 between the tubing and the well bore (see FIG. 3). When the liquid level in the annulus 27 between the production tubing and the well bore is down, the load on the drive head is the highest and consists of the weight of the drive string minus buoyancy plus the hydrostatic pressure of the liquid column in the production tubing 29 above the pump rotor. This maximum load can be calculated taking into consideration the depth of the pump 26 and the density of the pumped liquid. Further, the liquid level in the well annulus 27 can be calculated from the difference between the theoretic maximum load on the drive head and the actual measured load by dividing the difference in weight by the theoretic weight of the liquid column in the well annulus 27 per unit of height.

The method of the present invention uses the strain gauges 31 to 38 on the drivehead frame 18 to determine the dynamic fluid levels at various pumping or production rates to calculate the maximum and minimum fluid levels. The formula (I) above is used in this calculation and the method of the present invention will now be described in greater detail.

To determine the fluid level in the wellbore 30, the pump 26 is started at a slow rate. Once the pump 26 is in operation and the pumped fluid reaches the surface, the weight on the drivehead frame 18 is a function of the dynamic fluid level as shown in FIG. 3. The weight of the drive string 38 less its buoyancy in the fluid plus the hydraulic loading from the hydrostatic head on the piston surface of the rotor of the pump 26 are relatively constant. Therefore, the weight strain on the drivehead becomes a function only of the dynamic fluid level.

The well is pumped at this initial rate until the fluid level in the annulus stabilizes. Stabilization is confirmed with the use of a fluid level sounder or bottom hole gauges well known in the art. Readings are taken in the annular space 27 between the production tubing and the well casing until the dynamic fluid level is stabilized. The signal from the strain gauges 31 to 38 is recorded and represents 'x' in the formula (I) above. This measurement corresponds to the depth to the fluid in the well bore, in other words, the first dynamic fluid level represented as 'M' in the formula (I) above.

Once the first dynamic load signal is recorded, the pump 26 is operated at a faster rate until the fluid level again stabilizes. The stabilization is confirmed in the same manner as described above. Once stabilization is reached at a second dynamic fluid level, the second load signal from the strain gauges 31 to 38 is recorded and represents 'y' in the formula (I) above. The second dynamic fluid level is designated 'N' in the formula (I) above.

The strain gauge signal 'w' at stable conditions at any dynamic fluid level with the production tubing full of fluid is calculated using formula II from above where D is the level for which it is desired to calculate the strain gauge signal. For example, when L equals the pump inlet depth, the strain gauge signal z can be calculated and the processor can be set to shut off the pump whenever that signal is produced by the strain gauges. The processor display 42 can now be set to read the depth of the static fluid level for any strain gauge signal. The second load signal y of the strain gauges at depth N is known and the sensitivity of the processor display can be set to read N when the strain gauge signal is y. The processor will now accurately display the depth of the fluid level in the annulus as long as the relationship between the fluid level and the production rate are linear.

The system of the present invention preferably incorporates a variable speed controller 44 (see FIG. 1) to regulate the speed of the pump 26 according to the height of the fluid level. The processor 40 can be calibrated to send a desired signal to the variable speed controller 44. For example, for a 0 to 15 mV output:

$$\text{output} = \frac{d-w}{d-z} * 15\ \text{mV}$$

wherein d is the load at the highest desired dynamic fluid level, z is the load with the liquid at the pump level and w is the actual load.

With these steps, most commercially available variable speed controllers 44 can be programmed to slow down as the signal from the processor 40 approaches 15mV and to speed up as the signal approaches 0mV. This arrangement maintains the fluid levels in the well 30 at a level which optimizes production and prevents burn-out of the pump 26.

In other preferred embodiments in accordance with the invention, the processor 40 connects to devices other than the variable speed controller 44, for example, an on-off switching device (not shown). The switching device is set with pre-determined set points to turn the pump 26 on and off when minimum and maximum fluid levels are reached. This will provide protection for the progressing cavity pump 26 to prevent burn-out and also optimize production. However, this type of arrangement increases the wear and tear on the system due to repeated start-ups and the use of a variable speed controller 44 is preferred.

The above-described embodiments of the present invention are meant to be illustrative of preferred embodiments of the present invention and are not intended to limit the scope of the present invention. Various modifications which would be readily apparent to one skilled in the art are intended to be within the scope of the present invention. The only limitations to the scope of the present invention are set out in the following appended claims.

The embodiments of the invention in which a exclusive right and privilege is claimed are defined as follows:

1. A method for controlling the production rate of a rotary downhole pump to prevent well pump-off, the well having a depth and the pump being driven by a drive string suspended from a drivehead at a wellhead of the well, an annulus being formed between the production tubing and one of the wellbore and the well casing, the pump being positioned in the wellhead at an insertion depth L, comprising the steps of:

operating the pump at a first speed less than a maximum rate of the pump until well fluid is produced at the wellhead;

continuing operation of the pump at the first speed until the fluid in the annulus has stabilized at a first dynamic fluid level;

determining a first static load on the drivehead at the first dynamic fluid level;

operating the pump at a second speed higher than the first speed until the fluid level in the annulus has stabilized at a second dynamic fluid level;

determining a second static load on the drivehead at the second dynamic fluid level;

determining a linear function of the load on the drivehead as a function of the fluid level in the annulus and;

reducing the speed of the pump when a critical load on the wellhead is reached which critical load is calculated on the basis of the linear function and corresponds to the level where the fluid level in the annulus is equal to the insertion depth of the pump.

2. The method of claim 1 further comprising the step of sending a signal to a variable speed means for altering the speed of the pump as the critical load is neared.

3. The method of claim 1 wherein the step of determining a linear function of the load on the drivehead is determined according to the following formula:

$$N-M=C(y-x) \qquad \text{(I)}$$

wherein N is the depth of the fluid in the annulus at the second dynamic fluid level, M is the depth of the fluid at the first dynamic fluid level, y is the second static load, and x is the first static load.

4. The method of claim 3 further including the step of providing a display and setting a display at z and the sensitivity of the display at C when the static load is y for displaying the depth of the fluid level in the annulus.

5. The method of claim 4 further including the step of sending a signal from the display to a variable speed controller for altering the speed of the pump when the display signal approaches a pre-selected minimum or maximum level.

6. The method of claim 5 wherein the step of sending a signal from the display to a variable speed controller includes the step of setting the sensitivity of the display so that the output Q is determined as follows:

$$Q = \frac{d - w}{d - z} * V_1$$

wherein d is the load at the highest desired dynamic fluid level and z is as defined above, w is the actual strain gauge signal, and $V_1$ is the maximum output voltage of the display.

7. The method of claim 6 wherein the maximum output voltage is set equal to an input voltage for the controller required to generate pump shut down.

8. An apparatus for controlling the production rate of a rotary downhole pump to prevent well pump-off, the well having a depth and the pump being driven by a drive string rotating in the production tubing and suspended form a drive head at a wellhead of the well, the pump being positioned in the wellhead at an insertion depth, an annulus being formed between the production tubing and one of the wellbore and the well casing and containing well fluid, the apparatus comprising:

means for producing a load signal which is a function of the static load on the wellhead generated by the pump and the drive string suspended from the wellhead;

a processor for monitoring the load signal and generating a control signal when a critical load is reached where the well fluid level in the annulus is equal to the insertion depth of the pump; and a controller for reducing the speed of the pump in response to the control signal generated by the controller.

9. The apparatus as defined in claim 8 wherein the processor produces a variable control signal depending on the load signal and the controller is a variable speed controller for gradually reducing the pump speed as the load signal approaches the critical load.

10. The apparatus as defined in claim 9 wherein the variable speed controller shuts down the pump in response to the control signal.

11. The apparatus as defined in claim 8 wherein the processor produces a variable control signal proportional to the load signal, the control signal varying between a pump-off signal generated when the critical load is reached and a restart signal corresponding to a load signal representing a pre-elected fluid level above the insertion depth of the pump, and the controller shuts down the pump when the pump-off signal is produced and reactivates the pump in response to the restart signal.

* * * * *